United States Patent [19]

Hamilton

[11] 4,048,782

[45] Sept. 20, 1977

[54] CONTROLLED FILM ADVANCE APPARATUS

[76] Inventor: Joel A. Hamilton, 101 Hardenburgh Ave., Demarest, N.J. 07627

[21] Appl. No.: 729,303

[22] Filed: Oct. 4, 1976

[51] Int. Cl.[2] ..... B65B 41/18

[52] U.S. Cl. ..... 53/51; 226/158; 53/184 R; 53/389; 93/8 R; 226/32; 226/115; 226/148; 226/156

[58] Field of Search ..... 53/51, 180, 183, 184 R, 53/389; 93/8 R, 33 H; 226/2, 32, 115, 148, 156, 158, 160

[56] References Cited

U.S. PATENT DOCUMENTS

| | | | |
|---|---|---|---|
| 2,749,817 | 6/1956 | Piazze et al. | 93/8 R |
| 3,762,617 | 10/1973 | Matthis | 226/32 |

FOREIGN PATENT DOCUMENTS

| | | | |
|---|---|---|---|
| 1,075,540 | 7/1967 | United Kingdom | 226/32 |

*Primary Examiner*—Robert Louis Spruill
*Attorney, Agent, or Firm*—Ralph R. Roberts

[57] ABSTRACT

The apparatus and method of this invention pertains to a web film advance in which a film advancing roll is carried on a frame moved by a reciprocating pitman arm. This arm is adjustable as to its stroke or travel so that a corresponding travel of the frame is also selectively adjustable. The film advancing roll is carried by a shaft mounted in bearings and is prevented from turning in one direction by a one-way clutch apparatus. This clutch allows the roll to be rotated only when the frame and roll are moved rearwardly. During this film feeding advance by the roller a rotation of the roller is achieved by a roller chain and a sprocket or a timing belt and toothed pulley. This chain or belt may be moved a small amount in response to an electrical signal to bring the web of film or paper into registration in accordance with mark indicia. Bags or simply formed, filled and sealed packages may be made by and on this simplified yet highly reliable film advancing apparatus.

19 Claims, 20 Drawing Figures

CONTROLLED FILM ADVANCE APPARATUS

BACKGROUND OF THE INVENTION

1. Field of the Invention

With reference to the classification of art as established in and by the United States Patent and Trademark Office the present invention is found in the general Class entitled, "Paper Manufacture" (Class 93) and in the subclass thereunder entitled, "cutting-including heating" (subclass 33 R & H). Reference is also made to the general Class entitled, "Package Making" (Class 53) and the subclass therein entitled, "progressively seamed cover webs or web folds" (subclass 177) and also the subclass entitled, "forming or partially forming receptacle and subsequently filling it" (subclass 183).

2. Description of the Prior Art

Bag making machines employing heat sealing and a severing knife are old in the art. It is also known to form a semirigid or rigid film into heated die formed shapes and to fill these pockets or forms with a product and then seal the product in each pocket or form. In the prior art devices known, the equipment to provide such bags or packages has been elaborate and expensive. In many such apparatus there is little or no adjustability to permit extensive and inexpensive change as to size, material or product. In the present invention a novel and inexpensive film feed is constructed so as to provide a wide range of selected sizes on the same apparatus. This size is infinitely variable within determined limits. Where package making and/or filling is to be combined with the film feed, the present apparatus provides the ready adjustment and/or replacement of the pocket forming apparatus which may be readily mounted to the proposed apparatus.

Prior United States Patents show film feeding in which oneway clutch actuation is desired and required. Intermittent advance is also shown. Amont patents to be noted are U.S. Pat. No. 3,667,354 to STEINMETZ as issued on June 6, 1972; U.S. Pat. No. 3,813,998 to LOTTO as issued on June 4, 1974 and U.S. Pat. No. 3,884,129 to MONAHAN as issued on May 20, 1975.

In these and other prior known devices the simple adjustable film feeding provided by the intermittent advance mechanism of the present invention is not disclosed or suggested.

The present invention provides an inexpensive and simple apparatus by which a film is advanced a selected amount in an intermittent manner. This advance also has means for moving the film slightly so that in response to a signal indicia, such as a printed mark, the film is advanced in a timed relation to a reading of this mark. The film advance includes a film advancing roller which is carried on a reciprocating platform which is preferably moved by a pitman arm. The drive of this arm is adjustable so that the movement of the platform is selected as to the travel. The film advance is further augmented by a roller chain or timing belt which is adapted to drive the film advancing roller by an arrangement of sprockets and one-way clutches.

SUMMARY OF THE INVENTION

The present invention may be summarized at least in part with reference to its objects.

It is an object of this invention to provide, and it does provide, a film advance in which a film feeding roller is carried on a reciprocated platform and during the forward travel of this platform the roll is prevented from turning by a one-way clutch apparatus. The forward feed of the film is further augmented by rotating the roller during the return travel of the platform by a roller chain and sprocket or a timing belt and toothed pulley arrangement.

It is a further object of this invention to provide, and it does provide, a film advance apparatus in which the roller chain or timing belt is moved a slight amount to provide a film registering means which is automatically actuated in response to the reading by an electric eye of a printed indicia such as a spot or line.

In brief, the present invention includes a reciprocated platform which preferably is moved by a pitman arm. The amount of or length of travel is adjustably determined by changing the effective length of the crank arm. The platform includes a film advancing roller which has a friction drive surface and which is combind with a pinch roller to grip the film to be advanced. The film advancing roller is carried on a shaft which is mounted in bearings and additionally has a one-way clutch which prevents the roller from turning to move the film counterflow to the advance. On the end of this shaft is carried a sprocket or toothed pulley. If a sprocket is used, a roller chain is in driving contact therewith and if a tooth pulley is used, a timing belt is in driving contact with the pulley. The chain or belt is fixed to the apparatus so that when the film advancing roller is carried rearwardly the roller rotates at a determined speed to move the film forwardly and preferably at a speed that is at least as fast as the rearward movement of the roller. An electric eye is often placed in the control apparatus and this eye "reads" the position of a print mark or dot. When this mark moves from the desired orientation the chain or belt is moved a small distance to bring the film advance toward or to a desired orientation.

In addition to the above summary the following disclosure is detailed to insure adequacy and aid in understanding of the invention. This disclosure, however, is not intended to cover each new inventive concept therein no matter how it may later be disguised by variations in form or additions of further improvements. For this reason there has been chosen a specific embodiment of the film advance apparatus as adopted for use for bag making and showing an alternate means for making small, sealed packages using this film advance. This specific embodiment and alternate embodiment thereof have been chosen for the purposes of illustration and description as shown in the accompanying drawings wherein:

BRIEF DESCRIPTION OF THE DRAWINGS

In the following description and in the claims various details are identified by specific names for convenience; these names, however, are intended to be generic in their application. Corresponding reference characters refer to like members throughout the several figures of the drawings.

Figure 1:
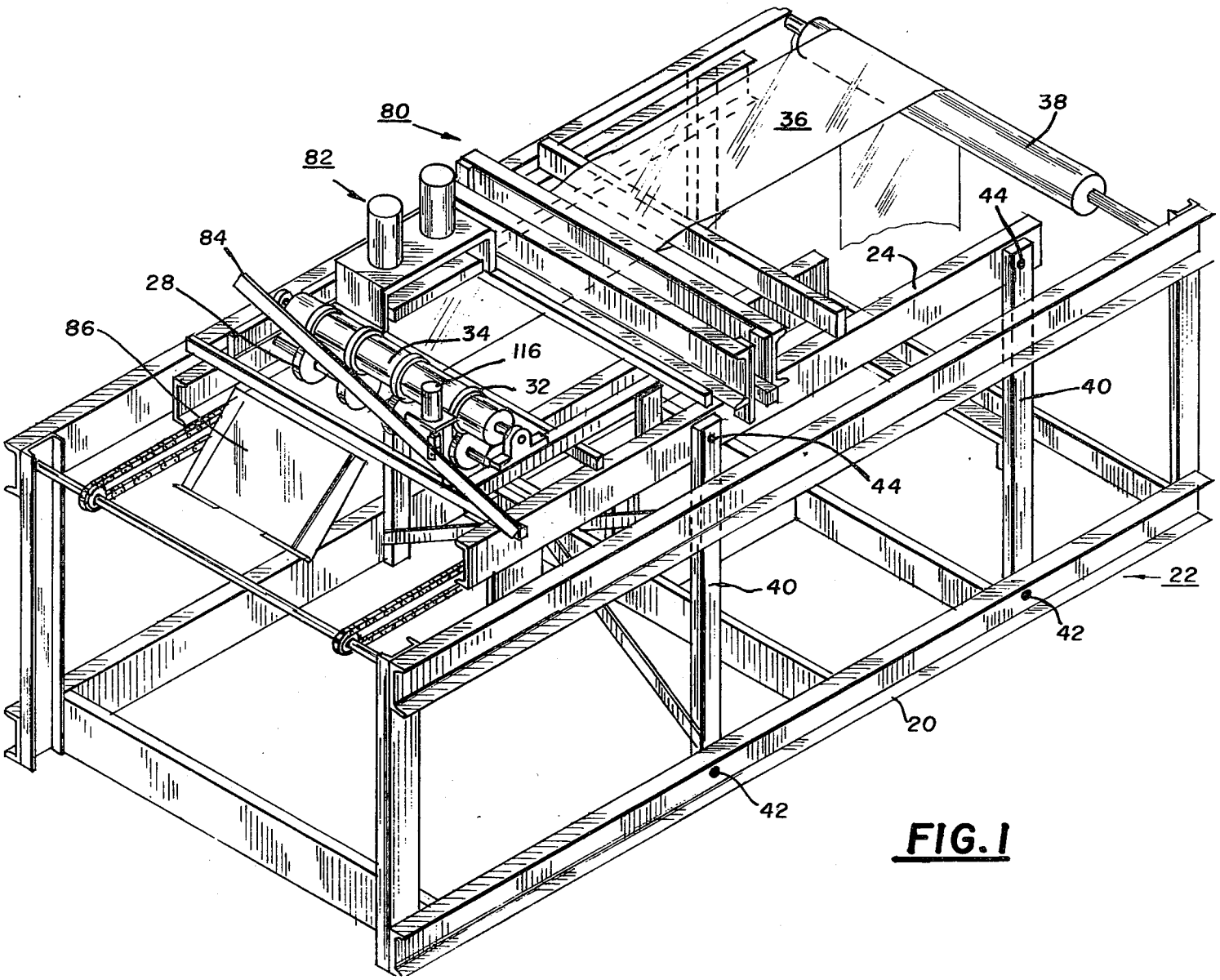
FIG. 1 represents an isometric, partly diagrammatic, view of a film advance mechanism of this invention and arranged for feeding to a heat sealing and cutting means whereby open-top bags are produced.

The drawings accompanying this specification disclose certain details of construction for the purpose of explanation of the invention, but it should be understood that structural details may be modified and that the invention may be incorporated in other structural forms than shown.

DESCRIPTION OF THE EMBODIMENT OF FIGS. 1 THROUGH 11

Referring next and now to the drawings there is shown film advancing apparatus in FIGS. 1 through 11 which further includes the forming of open-top bags. On a fixed frame 22 there is carried a movable frame 24 which has mounted thereon a film advancing roller shaft 26. As seen particularly in FIG. 3, this lower shaft carries a multiplicity of like rollers or discs 28. Each disc preferably has mounted thereon a rubber belt or ring 30. This belt is sufficiently resilient so that when in engagement with the land portions 32 formed or provided on the upper roller 34 the film or films 36, when gripped therebetween, are moved forwardly in response to the movement and rotation of the shaft 26. The belt or ring 30 may be of plastic, if desired, but a small amount of resilience in the belt is desirable.

The movable frame 24, as shown, is carried on four pivoted arm supports 40. These arms supports are pivotally carried by pins 42 mounted in appropriate bearings or holes formed in the bottom rail of frame 20. The upper end of the arms 40 carry pins or pivot bolts 44 which are also secured in appropriate holes or bearings formed or mounted at the top of arms 40 and in the movable frame 24. As seen in FIGS. 7 through 11, the arms 40 are moved by a pitman arm 46 which is in turn moved by crank arm 48. For the purpose of adjustment, there is provided in crank arm 48 a recessed slot 50 through which the shank of a connecting bolt 52 extends. The head of this bolt is retained in the slot recess 50 so that the pivoted end of the pitman arm 46 can pass by the head of the bolt. A crank or pivot pin 54 is carried in a bearing end portion of the arm 48 and operatively connects the arm 48 and the pitman arm 46.

Figure 9:
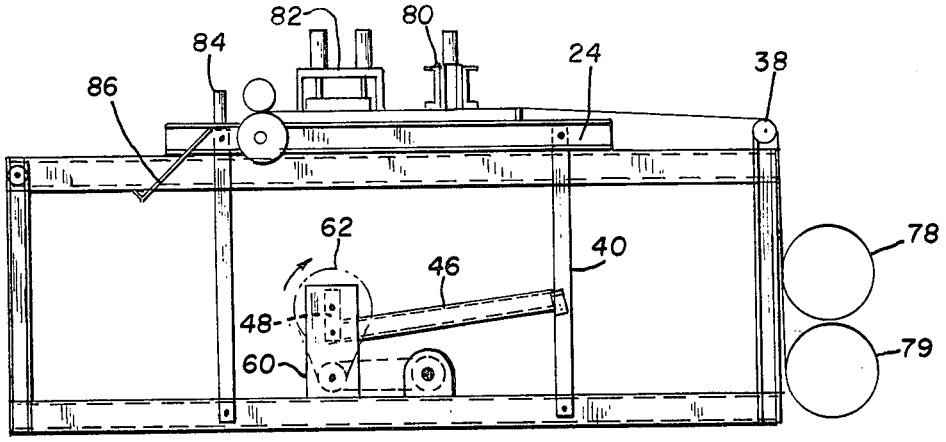
FIGS. 9, 10 and 11 represent side views of the pitman arm drive for the apparatus of FIG. 1 and in a more-or-less diagrammatic representation in a slightly reduced scale the carriage is shown at its median, forward and rearward limit of movement.
Figure 10:
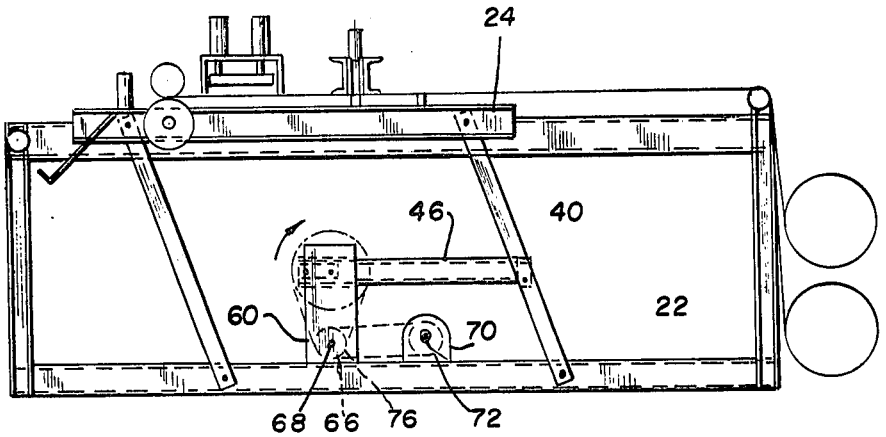
Figure 11:
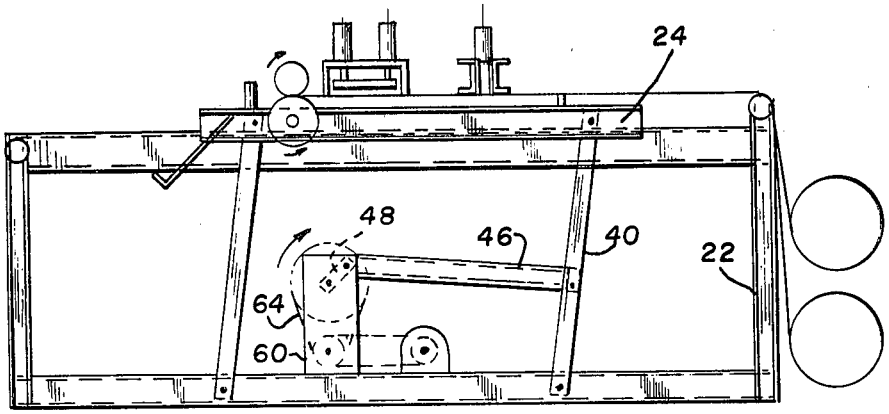

Still referring to FIGS. 9–11 and FIGS. 7 and 8, it is to be noted that crank arm 48 is attached at its inner end to a shaft 56 and or shaft end connector 57. This shaft is carried by a bearing 58 in pedestal support 60. As a means for slowing the rotation of shaft 56 there is provided a belt reducing drive. As shown, a sheave 62 carried by shaft 56 is driven by a belt 64 driven by a sheave 66 carried by shaft 68 which is exemplified as mounted on and in pedestal support 60. This shaft 68 is carried in bearings so as to be readily turned by a motor 70 which rotates a sheave 72 carried on the shaft of the motor. Sheave 72 drives a belt 74 and a driven sheave 76 carried on the shaft 68. As seen in FIG. 9, the crank arm 48 is about at its bottom limit. Pitman arm 46 has its outer end connected by a pivot pin 78 to an arm support 40. The movable frame 24 carried by these arms is substantially midway of its extremes of movement. In FIG. 10, the crank arm 48 has moved about $\frac{1}{4}$ turn clockwise to bring the movable frame to its leftward extent which, as viewed, is the discharge limit of movement. In FIG. 11, the crank arm 48 has moved further clockwardly about three-eighths of a revolution to move the movable frame 24 toward its forward position.

Still referring to FIGS. 9, 10 and 11, there are depicted upper and lower rolls 78 and 79 which carry like weight, width and composition of film 36. These films are fed upwardly to and in a redirection leftwardly from the film delivery roller 38 to a transverse heat sealing strip means 80. This may employ one or two heat sealing bars with the upper bars moved to and from sealing engagement by an air cylinder and a spring. This seal is contemplated as being more-or-less the entire width of the strip of films but this is merely a matter of selection. A short distance dowstream or leftwardly of the transverse seal is a longitudinal heat sealing strip means 82. This also may employ one or two heat sealing bars with one bar moved to and from sealing engagement by an air cylinder and a spring. The length of the longitudinal seal is made to provide the desired seal of one end of the bags to be produced. A short distance to the left of the longitudinal sealing means 82 is a transverse cutting means 84. This cutting means is contemplated as severing the upper and lower films 36 preferably between adjacent transverse seals simultaneously produced by the transverse sealing means 80. A receiving tray or slide 86 is disposed to receive the sealed and severed bags.

It is to be noted that both the sealing means 80 and 82 as well as the cutting means 84 and the tray 86 are carried by and are movable with the reciprocating moving frame 24. The increase in the width of the films may require a modification or change in the transverse sealing means 80. The seal may provide two simultaneous seals or may be one wide seal that is cut midway by the cutting means 84 at the later station. The longitudinal seal may be an overlap, if desired, but a change in the length of the longitudinal sealing means 82 is the preferred arrangement. A change in the travel of the pitman arm 46 are provided by the crank arm 48 and the bolt 52 enables a ready and rapid change in the forward travel of the moving frame 24 and the resulting bag width. The height is determined by the width of the film. It is also to be noted that folded film as carried on a roll can be provided and when this is done the longitudinal sealing means 82 is not required or used.

Figure 2:
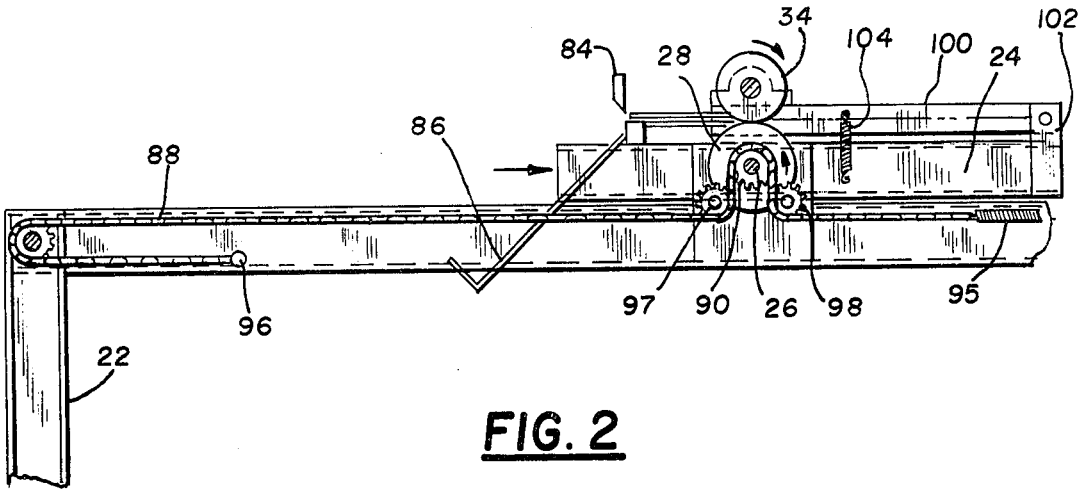
FIG. 2 represents a side view, partly diagrammatic, and showing the film advance mechanism of FIG. 1 and the means of driving the film advance roller during the rearward movement of a traveling platform.
Figure 3:
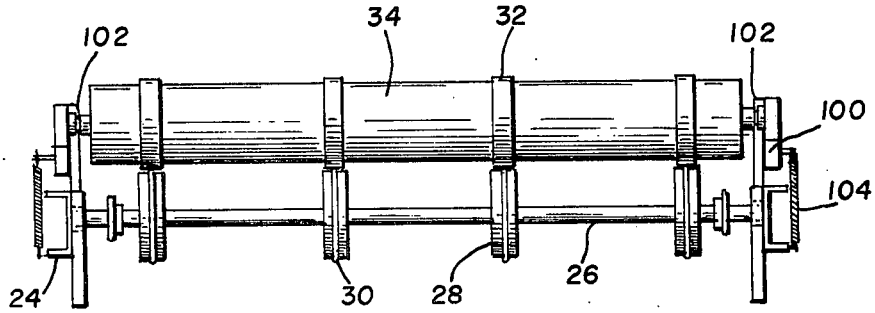
FIG. 3 represents in an enlarged scale the film advancing roller and its companion top roller.
Figure 4:
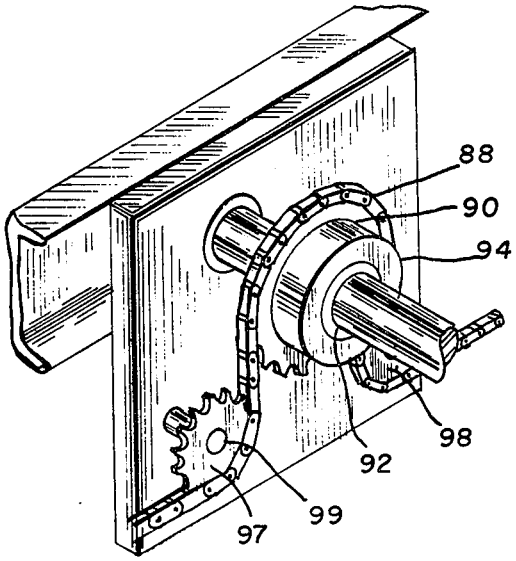
FIG. 4 represents a fragmentary, isometric view showing a roller chain drive for the lower roller of the film advance mechanism.

Referring next to FIGS. 2, 3 and 4, there is depicted the novel film advance mechanism of this invention. In FIG. 2, a simplified representation fragmentary shows the fixed frame 22 and the moving frame 24. The lower film advancing rollers 28 as carried by shaft 26 are driven in a counterclockwise direction by a roller chain 88 and a sprocket 90. A one-way clutch apparatus 92, which may be carried in the hub 94 of the sprocket 90, prevents rotation in a clockwise direction, as shown. Chain 88 has one end retained by a tension spring 95 which is secured to the fixed frame as is the other end of the chain which is also fixed to the frame by the bolt 96. As shown, idler rollers 97 and 98, which are free turning on shafts 99, are adapted to insure a full half wrap of chain 88 around the sprocket 90. Also shown in FIG. 2 are arms 100 which are pivotally mounted on their right ends to a pivot support 102. These arms carry on their leftward ends the upper roller 34 and by tension springs 104 connected to arms 102 and frame 24 the land portions 32 are urged toward and to rubber belts 30.

In use, the film or films 36 are brought to and between the upper roller 34 and the rubber belts 30 on the lower rollers 28. When the moving frame 24 is moved leftwardly the chain 88 is retained more-or-less as shown in FIG. 2. The clutch is adapted to permit the sprocket 90 to free turn in a clockwise direction. The spring 95 draws the chain 88 into a tight condition. When and as the movable frame moves to the extreme right, the clutch actuates to lock the shaft 26 and sprocket 90 so that with the rightward movement of the rollers and frame 24 the sprocket 90 and the rollers 28 are rotated counterclockwise. The film or films 36 which are brought to and between the upper and lower rollers are moved between these rollers in accordance with the rotation of the sprocket 90 and the roller 28.

In practice, the rotation of the film advance rollers is preferably at or in excess of the rightward rate of travel of the frame 24. The advance is preferably at least slightly greater than the rightward travel of the roller to prevent a sag in the film extent between the rollers 30 and 34 and the roller 38. During leftward movement the film rollers 30 and 34 pinch and retain the film therebetween. The rollers 30 do not rotate so the forward travel of film is equal to the travel of the frame 24 and the rotation of the rollers 30.

Figure 5:
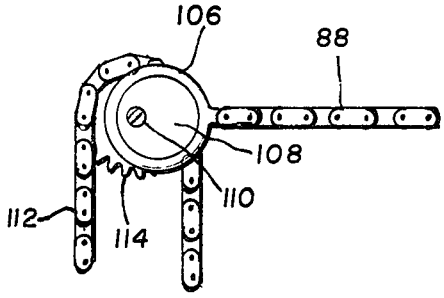
FIG. 5 represents an enlarged side view of an eccentric securing ring by which a chain end connected to this eccentric is moved in response to a signal from an electric eye or the like and by which an unwanted advance or retard of the film advance is automatically noted and corrected.
Figure 8:
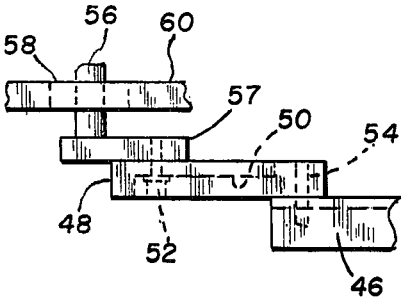
FIG. 8 represents a plan view taken on the line 8—8 of FIG. 7 and showing the arrangement of the preferred components in the adjustable throw of the pitman arm.
Figure 7:
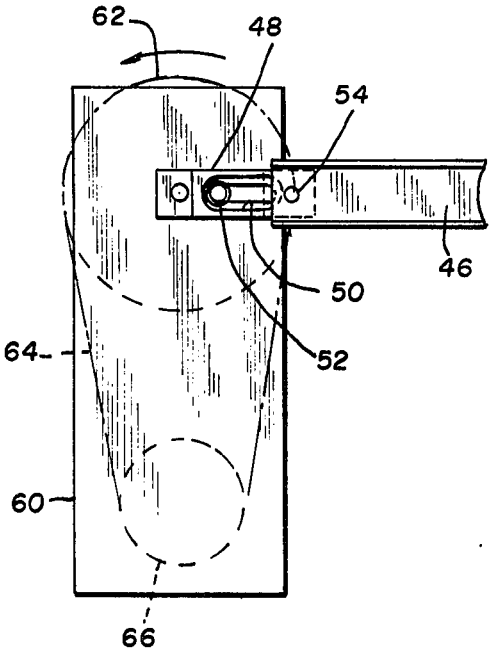
FIG. 7 represents in an enlarged side view and partly diagrammatic the adjustable pitman arm drive of FIG. 1.
Figure 6:
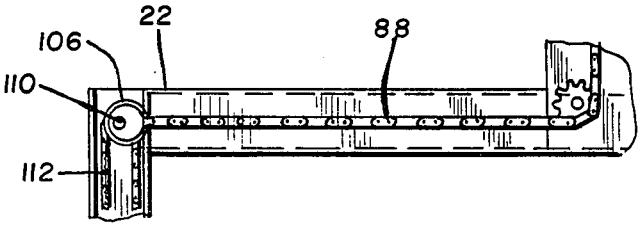
FIG. 6 represents a view similar to that of FIG. 2 with the chain driving the film advance roller secured to the eccentric apparatus, as shown in FIG. 5.

ALTERNATE CHAIN ARRANGEMENT OF FIGS. 5 and 6

Referring next to FIGS. 5 and 6, it is to be noted that an alternate is provided to the chain arrangement of FIG. 2. The chain 88 is secured at its left end to a ring member 106. An eccentric disc 108 is carried on the ends of shaft 110 which is carried in bearings carried by the frame 22. A roller chain 112 is in driving contact with sprocket 114 carried by shaft 110 and as the sprocket 114 is rotated it moves the eccentric 108 and the chain 88. The movement of the chain 88 is in response to the reading of the indicia which has been placed on the film as by printing. The chain 112 is moved by a pneumatic cylinder, an electric gear motor or other conventional power means which are readily responsive to an electrical signal which may derive from an electric eye 116 (FIG. 1). The "reading" of printed indicia may require an advance or retard of the film which is easily accomplished by a small change in the eccentric. Since the adjustment of the crank arm usually causes the film to feed a small amount either too fast or too slow, the automatic adjustment is usually in a more-or-lss constant use.

ALTERNATE EMBODIMENT OF FIGS. 12 THROUGH 19

Figure 12:
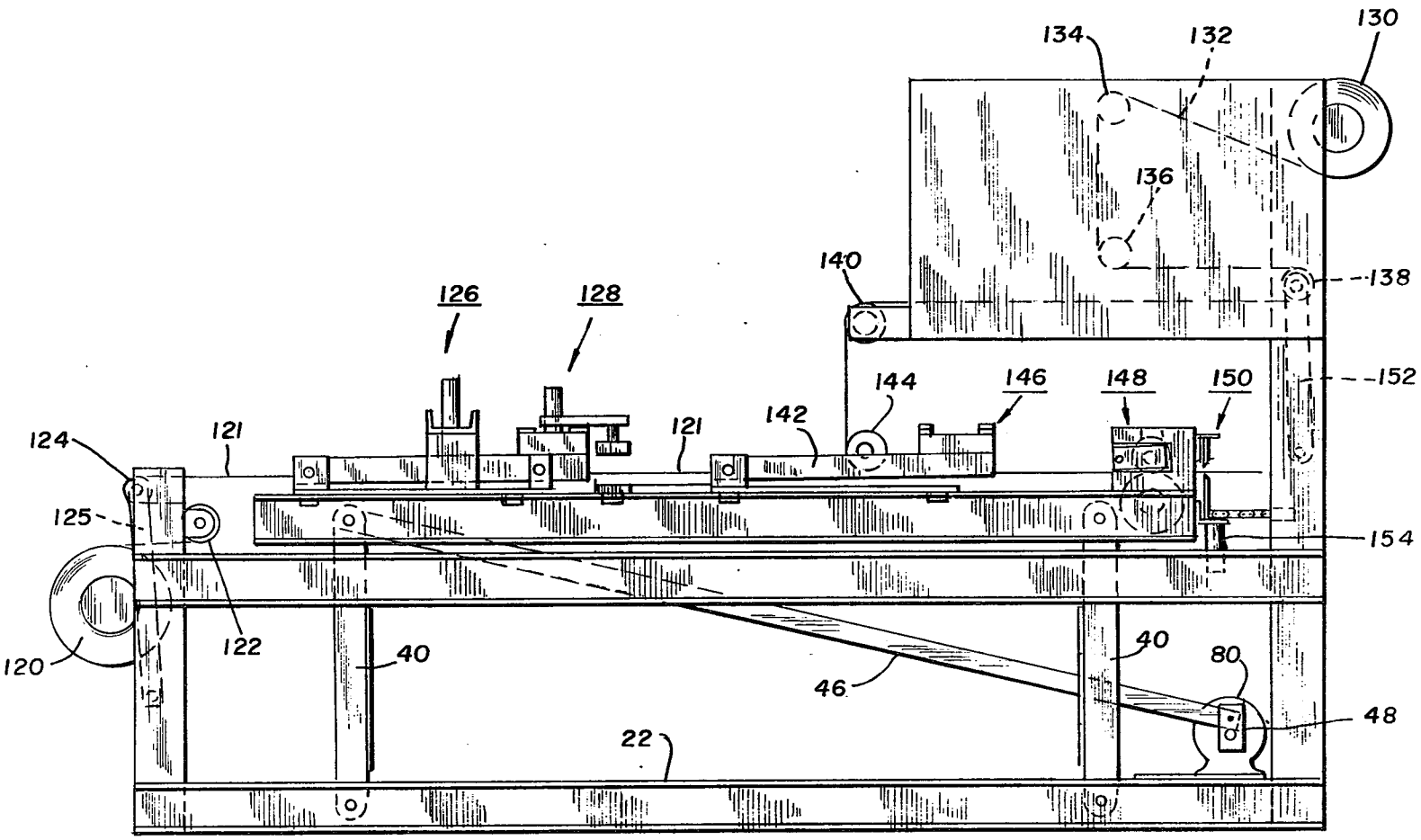
FIG. 12 represents a side view of a film feeding apparatus as adapted for use with pouch or pocket forming, filling, covering and severing apparatus.

Referring next to the alternate apparatus of FIGS. 12 through 19, there is shown the film advance apparatus further used with pouch or cavity forming and applying apparatus. In the apparatus shown in FIG. 12, the fixed frame 22, the movable frame 24 and the arm supports 40 are as shown in the prior described apparatus. A lower film supply roll 120 is carried on the left end of the frame 22. A motor 70 and crank arm 48 as carried thereon moves a pitman arm 46 which is connected at its left end to pivot pin 44. This lower film 121 is preferably of a rigid or semirigid plastic which may be only a few thousandths of an inch in thickness. This film is delivered from the roll 120 to and around rollers 122 and 124 which provide a path for the film as it is drawn from the roll 120. Roller 124 is carried on pivoted arms 125 which actuate and control a brake to be later discussed. At a station 126 the lower film is formed as with pockets or cavities by a heated die. This form or shape is a matter of commercial choice and may be one or more cavities or shapes formed side-by-side. The apparatus of this invention is contemplated as being readily removable from the movable frame 24 so that ready changeover can be achieved. If desired, an automatic feeding or dispensing station 128 is provided to fill the formed cavities with the desired product. At the upper right of the apparatus, as seen in FIG. 12, there is provided a cover film 130. This film is often printed with instructions or other identifying matter including a printed spot or line by which the relationship of the cover to the pockets and cutting means is to be established and maintained. From roll 130 the upper fiml 132 is fed to and around rollers 134, 136, 138 and 140. This roller 140 is disposed above the package to be covered a distance sufficient for the film 132 to move in a back and forth manner without a severe or sudden strain on the film.

Still referring to FIG. 12, it is to be noted that carried on pivoted arms 142 is a pressure roller 144 which is disposed to press the cover in place on the lower film package. To the right of roller 144 is a serrating station 146 which perforates the packages in a desired pattern, usually both transverse and longitudinal. Still carried on the frame 24 and to the right of the serrating station 146 is film advance station 148. This film advance is much like that shown in FIGS. 2, 3 and 4, and shown in detail in FIGS. 13, 14 and 15. A film cutoff 150 is shown to the right of station 148. This cutoff provides a transverse cutting of the film at the determined intervals as provided by a counting mechanism, not shown. Roller 138 is carried on arms 152 which are pivotally carried by frame 22. These arms are moved counterclockwise when the film 132 is moved forwardly by the film advancing 148. A brake is provided on the shaft carrying roll 130 so that in the intermittent withdrawal of film the film is not excessively withdrawn. The brake and movement of arms are carefully synchronized so that the cover film is fed in a manner to prevent unwanted resistance and sag of the film 132. As depicted, the lower knife is cutoff station 150 is moved and carried by an air cylinder or cylinders 154.

Figure 13:
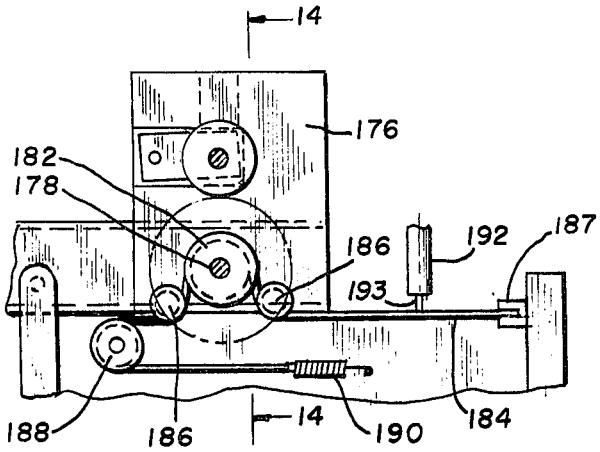
FIG. 13 represents in an enlarged scale a flim advance mechanism as in FIG. 12, this side view partly fragmentary and diagrammatic and showing a timing belt and a method of advancing the package in accordance with an electronic eye reading of printed indicia.
Figure 14:
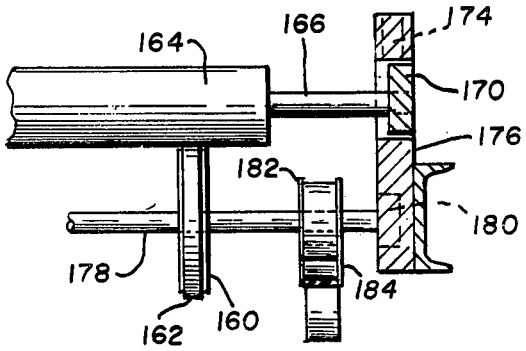
FIG. 14 represents an end view, partly fragmentary and diagrammatic with the view taken on the line 14—14 of FIG. 13 and looking in the direction of the arrows.
Figure 15:
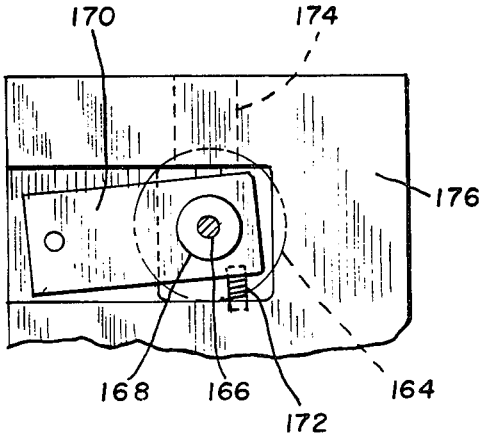
FIG. 15 represents a side view in an enlarged scale and partly fragmentary showing a pneumatic method by which the pressure roller is urged into place during the feeding of the film.

Referring next to FIGS. 13, 14 and 15, there is shown in enlarged detail the film advancing mechanism 148, as shown in FIG. 12. As depicted, in the greater detail the lower rollers 160 have a resilient tire or ring 162. These rollers are spaced so as to avoid engagement with the pockets or pouches formed in the lower film 121. As depicted, an upper roller 164 is a straight roller which is, therefore, adapted to engage the resilient tires 162 of the lower roller no matter how they are spaced. Roller 164 is carried by shaft 166 whose ends are carried in bearings 168 in pivoted arms 170. These arms are urged upwardly by springs 172 for ease of insertion of the film between the rollers. During operation the arms 170 and upper roller 164 are urged into film gripping condition by pneumatic cylinder 174. The downward force applied by the cylinder 174 is adjusted to provide the desired grasp of the pressed together films 121 and 132 by the roller 164 and resilient tires 162. The upper roller is lifted above tires 162 during non-use of the apparatus.

The film advance station 148 is carried by movable frame 24 and by the pivoted arms 40. A support member 176 carries both the upper roller 164 and the lower roller assembly 160. A shaft 178 carries the lower rollers 160 in bearings 180 mounted in the support member 176. On this shaft is also carried a toothed sheave 182 which is movable in only one direction by a one-way clutch, not shown. As seen in FIG. 13, the sheave 182 is movable freely in a counterclockwise direction. To insure nearly or a one-half diameter wrap of a toothed timing belt 184 around the sheave 182 there are provided idler pulleys 186. Timing belt 184 is secured at its right end 187 to the fixed frame 22 and after passing around pulleys or sheaves 182 and 186 the belt is carried to and around free turning sheave 188. The lower extent of the belt 184 is secured to a spring 190 also secured to a portion of the fixed frame 22.

A short distance to the left of secured end 187 is mounted a pneumatic cylinder 192 which is responsive to an electric eye, not shown. This eye reads the indicia or printed marks on the cover and in response to a decrease in the desired advance of the film cover as indicated by the mark, the pneumatic cylinder is actuated to move a piston rod 193 therein downwardly to cause a downward bowing of the belt 184 and a corresponding slight increase in the forward rotation of rollers 160 and the mounted tires 162. In operation, as the package is advanced the reading of the printed mark causes an actuation of the cylinder 192 which moves the piston rod 193 downwardly to bow belt 184 as above-noted and thus moves the film an additional short distance forwardly.

Figure 16:
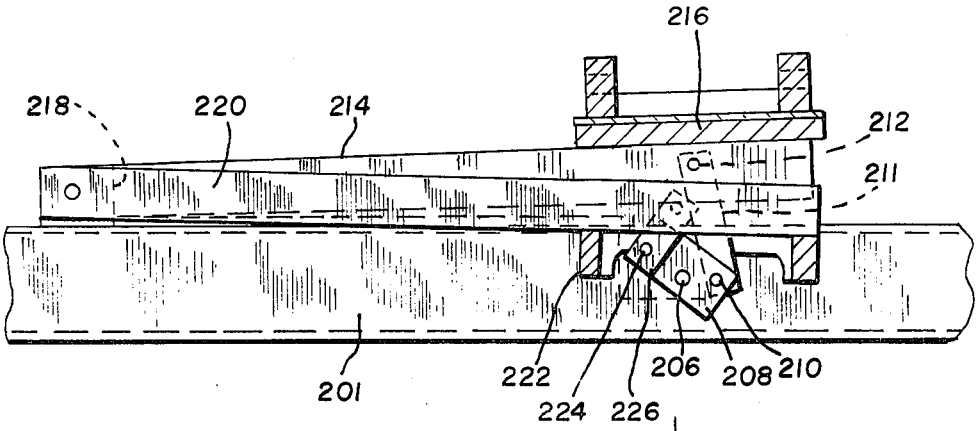
FIG. 16 represents a side view, partly fragmentary and in section of the upper and lower platforms adapted for removably mounting forming dies, this view showing the toggle in open condition.
Figure 17:
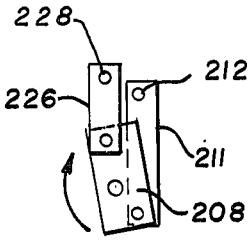
FIG. 17 represents the side view of the toggle mechanism of FIG. 16, this view partly fragmentary and showing the toggle in closed condition.
Figure 18:
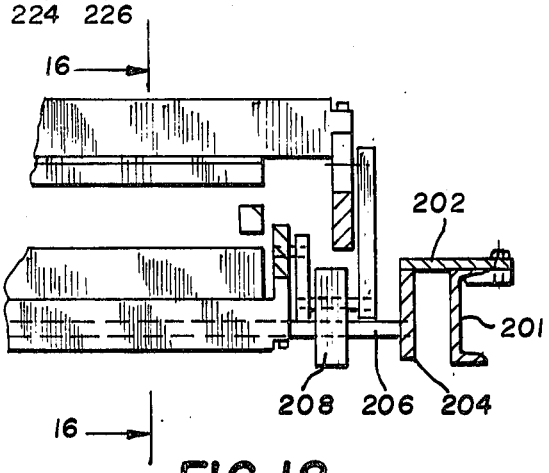
FIG. 18 represents a partly sectional and transverse view of the toggle mechanism of FIG. 16.
Figure 19:
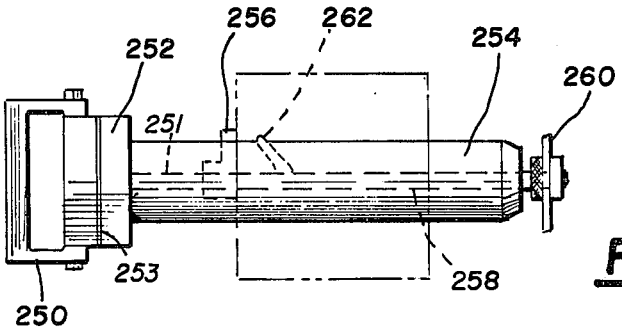
FIG. 19 represents a side view, partly fragmentary and diagrammatic of the film holding spool and showing a means of centering the roll and securing the roll at this established limit.

TOGGLE MECHANISM OF FIGS. 16, 17 and 18

Referring next to FIGS. 16 thru 18, there is shown a toggle mechanism by which the lower film 121, shown in FIG. 12, is formed at station 128. As shown, on the outer channel member 201 of movable frame 24 there is a support plate 202 which is attached to side member 204. A shaft 206 is carried by this and a like side member on the other side of the frame 24. A turn support member 208 is carried by this shaft and is turned when the shaft is turned. A pivot pin 210 is carried in turn support member 208 and supports an attached pivot link 211 and at its upper end carries a pin 212 which is pivotally mounted in pivotally secured arms 214 which carry the upper die frame 216. A pilot block 218 carries the leftward end of arm 214 and also arm 220 which carries and is attached to lower die frame 222.

A pivot pin 224 which is carried in turn support member 208 supports an attached pivoted link 226. Pivot pin 228 is also carried by the link 226 at its other end and is pivotally connected to the lower die frame 222. As seen in FIG. 17, when the shaft 206 is turned about a quarter turn clockwise, as indicated by the arrow, the turn support member 208 is also moved to a more-or-less vertical position to bring the lower die frame upwardly to a closed condition. The upper die frame may also carry pneumatic cylinder or cylinders 230 which move the forming male die into female cavities carried by and on the lower frame. The simple toggle apparatus illustrated give a mechanical advantage and carries the lower die frame in a desired parallel manner. Other die frame movements can be provided and this toggle mechanism is not presented as novel but merely as one method for easily providing apparatus for removably mounting die forming apparatus as required and determined by the requirements of the product.

ROLL MOUNTING APPARATUS OF FIG. 19

Referring next to the roll mounting spindle as provided with the film feeding apparatus of FIGS. 1 and 12. As depicted, a roll pay-off spindle includes a pivot bracket 250 in which a bearing and brake assembly 252 controls any free rotation of the film roll. This pivoted assembly 252 contains a bearing, not shown, and a pneumatic brake 253. The left portion of the assembly 252 may be swung in the clevis provided by bracket 250. The left and right halves of the assembly 252 are maintained in a parallel association with each other. The bearing in this assembly carries a shaft 251 and in association with this shaft and its rotation is a conventional air brake which provides a changeable drag on the rotation of the shaft as sensed by an arm. Such a sensing is depicted by arms 125 and 152 as in FIG. 12. A core member 254 is a sliding fit for the core of the film roll. A stop 256 is carried in a slot provided in the core member 254. A screw 258 is carried in the center of the core member 254. A handle or knob 260, which is on the right end of core member 254, is connected to screw 258 and as it is turned moves stop 256. Also movable and actuated by a screw means in the core member 254 is a locking finger 262. This finger is moved in response to a rotation of the screw so as to be moved with its outer end swung outwardly in a driving engagement with the inner core of a roll of film. The stop 256 is moved to position the film as to the desired path and finger 262 secures the roll of film at this position. This roll mounting arrangement is used with both the roll of lower film 120 and the roll of upper film 130. The brake actuation control for roll 130 is provided by the movement of arms 152. The brake for roll 120 is provided by pivoted arms 125.

ALTERNATE MOTIVE POWER OF FIG. 20

Figure 20:
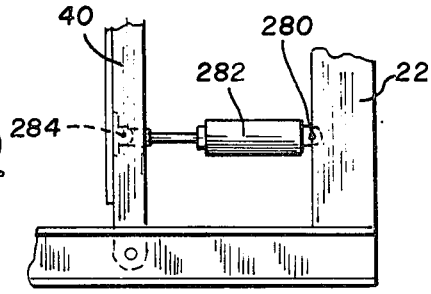
FIG. 20 represents a fragmentary side view of the apparatus of FIG. 12 and showing a hydraulic cylinder as the motive power rather than the electric motor and pitman arm shown in the apparatus of FIG. 12.

Referring next and finally to FIG. 20, there is shown an alternate motive power for cycling the frame 24. As shown, there is a clevis tongue 280 which is secured to frame 22. A cylinder 282 is secured at one end to this tongue and at the other end is connected by a pivot pin 284 to a pivoted arm support 40. The cylinder 282 may be a pneumatic cylinder or a hydraulic cylinder with a throttling valve to control the speed and duration of stroke. The motor 80 and the pitman arm 46 produce a harmonic cycle which is preferable in many film processing operations.

It is to be noted that the movable frame as carried on pivoted arms 40 in FIGS. 1 and 12 may also be carried by rollers in conjunction and combination with the fixed frames. For example, flanged rollers carried on the fixed frame may be adapted to carry the movable frame in a common plane. As an alternate, the rollers can be carried on the movable frame and engage and traverse track portions provided on the fixed frame. Other arrangements as seen in table grinding apparatus may also be utilized. No matter the method and means of suspension, the movable frame must be reciprocably moved with little force and preferably the mechanism should be simple, inexpensive and not subject to wear and/or erratic performance because of dust and like abrasive particles and environment.

The use of a spring such as spring 190, shown in FIG. 13, is shown as an inexpensive belt tensioning or take-up means. Alternately the belt or chain may be kept taut by a weight or a pneumatic cylinder. Any device that maintains the belt or chain tightly wrapped to the sprocket or toothed pulley during the reciprocal movement is satisfactory.

USE AND OPERATION OF THE APPARATUS OF FIGS. 12-20

The film advancing apparatus as shown in the FIGS. 12 thru 20 employ the same general concept as that described in conjunction with FIGS. 1 thru 11. This further alternate embodiment provides the making of packages and the covering of these packages rather than making open top bags. The lower film 121 carried on roll 120 may be rigid or semirigid as determined by the product to be packaged. It is contemplated that the film will be readily shaped in heated dies and as shown in FIGS. 16 thru 18 these dies are carried by apparatus which is toggle actuated. Other conventional means can be provided, if desired. The removing of the formed film from the female die portions can and usually is provided by stripping means such as fingers or resilient means. The filling of the pouches or pockets is usually by automatic means which is adapted to the product to be placed in the pocket.

The upper film 132 is fed from roll 130 and to the pressure roller 144. If serrations are to be produced they may be provided at station 146. This is a matter of choice depending upon the packages to be provided. With the package formed and filled, the film advance mechanism is actuated. The moving frame 24 is cycled back and forth in response to the pitman arm 46 and the crank 48 carried on and by the motor 80. The extent of cycle and associated rotation of the rollers 160 determine the extent of film advance. This advance occurs during the extent of rightward travel of the frame 24 and is a result of the rotation of rollers 160 during the leftward movement of the frame 24. This rotation is derived from the driving of toothed pulley or sheave 182 by the timing belt 184 which is secured at 187 to fixed frame 22. The one-way clutch causes rollers 160 to be turned clockwise, as in FIG. 13, when the movable frame is moved leftwardly. This same clutch prevents a counterclockwise rotation when the movable frame is moved rightwardly. The derived rotation of rollers 160 is preferably greater than the rearward or leftwardly travel of the frame 24. Preferably the rollers 160 are rotated by the pulley 182 as driven by belt 184 and about double the speed of travel of the frame 24. This results in a double advance of the film or films in relation to the rightward travel of the frame.

The amount of travel of the frame 24 is selected to suit the product being packaged. The automatic positioning device which is provided by the cylinder 192 is in response to the reading of printed or like prepared marking devices on the cover. Usually the advance is to move the film forwardly after it has fallen a small distance behind. This action can be reversed, if desired. The timing of the cutoff knife 150 is merely a matter of selection and can occur with every advance or at multiplies thereof. The apparatus, shown in FIG. 12, may produce one of more multiples of pockets as determined by the user. The repetition of the apparatus enables a package to be like formed, filled, covered and severed in accordance with the package requirements.

The above apparatus also suggests a method of advancing a supplied film which is to be sealed, shaped, cut, laminated and the like during and with an intermittent advance, said method including the steps of: providing a fixed frame; removably carrying at least one roll of supply film on this fixed frame; movably carrying a second frame on and by the fixed frame, the movement of this second frame being in a back and forth determined path and pattern; carrying a film feed roller by a shaft mounted on the movable second frame, this film feeding roller adpated to receive the film from the supply roll; mounting a one-way clutch on the film feed roller shaft and arranging said clutch so as to permit the film feeding roller to be turned only in a direction to move the film toward the discharging end of the film path; mounting a toothed member on the shaft carrying the film feed roller and one-way clutch; mounting a drive chain, belt and the like so as to have one end attached to the fixed frame and the other end to a take-up means whereby the chain, belt and the like is maintained in a taut condition and in driving arrangement with the toothed member as the movable second frame is cycled back and forth; selectively changing the effective length of the chain, belt and the like in that extent of length between the end fixed to the frame and the toothed member, this change in effective length being in response to a signal initiated in response to a comparing of the actual film advance of film in relation to the desired advance of film; mounting a pressure roller on the movable second frame so as to push the film as fed from the supply roll to and against the film feeding roller and holding this supply of film between the film feed roller and pressure roller so that only a forward rotation of the film feeding roller occurs because of the one-way clutch and the film is advanced therebetween only during rearward movement of the second frame, and cycling the movable second frame back and forth by and with motive means so that a determined path and extent are provided with this second frame being moved from the head end and toward the tail end and vice versa, the film between the pressure roller and film feed roller on the movement of the second frame from the head end toward the tail end being prevented from moving by the one-way clutch action on the feeding roller shaft and during the return stroke of the movable second frame toward the head end, driving the toothed member and the film feeding roller so as to rotate the shaft and roller to advance the supply film between these rollers to that extent as determined by the relative rotation of the toothed member and the relative diameter of the film feeding roller, that extent of fed film being carried toward the discharge by the film feeding and pressure rollers as these rollers are advanced toward the discharge end of the film path.

In the preferred embodiments above the shaft carrying the lower roll is operatively connected to a one-way clutch which prevents the turning of the roll except to advance the film forwardly. The toothed sprocket or pulley also carried on the end of this shaft also has its own one-way clutch by which the film advancing roll is moved when the movable frame is moved from its discharge end. The upper roll is also carried on a shaft and as an insurance against any backflow movement of the film there is also provided a one-way clutch.

Terms such as "left", "right", "up", "down", "bottom", "top", "front", "back", "in", "out", "clockwise", "counterclockwise" and the like are applicable to the embodiments shown and described in conjunction with the drawings. These terms are merely for the purposes of description and do not necessarily apply to the position in which the film advancing apparatus may be constructed or used.

While particular embodiments of the film advancing apparatus have been shown and described it is to be understood the invention is not limited thereto since modifications may be made within the scope of the accompanying claims and protection is sought to the broadest extent the prior art allows.

What is claimed is:

1. A film advancing apparatus for supplied film which is to be sealed, shaped, cut, laminated and the like during and with an intermittent advance, said apparatus including: (a) a fixed frame; (b) means for removably supporting at least one supply roll of film carried by this fixed frame; (c) a movable frame carried by the fixed frame so as to be cycled in a back and forth determined path and pattern; (d) a film feed roller carried by a shaft mounted on and movable with the movable frame and adapted to receive the film from the supply roll; (e) a one-way clutch carried by the film feed roller shaft, said clutch arranged so as to permit the film feeding roller and shaft to be turned only in a direction to move the film toward the discharge end of the apparatus; (f) a toothed member carried by the shaft carrying the film feed roller and one-way clutch; (g) a flexible drive means having one end operatively attached to the fixed frame and the other to a take-up means adapted to maintain the flexible drive means in a taut condition and in a driving engagement with the toothed member as the movable frame is cycled back and forth; (h) an adjusting means for selectively changing the effective length of the flexible drive means in that extent of length between the end operatively fixed to the frame and the toothed member, said extent being changed in response to a signal which is actuated in response to the comparing of the actual advance of the film in relation to the desired advance of the film; (i) a pressure roller disposed to push the film being fed from the supply roll to the film feeding roller and to hold this supply film therebetween so that only a forward rotation of the film feeding roller occurs and the film is advanced therebetween and, (j) motive means for cycling the movable frame back and forth in a determined path and extent whereby the movable frame is moved from the head end and toward the discharge end of the apparatus and the film between the pressure roller and film feed roller is prevented from moving by the one-way clutch action on the feeding roller shaft and during the return stroke of the movable frame toward the head end the toothed member on the film feeding roller shaft is driven by the engaged flexible drive means to rotate the shaft and the film feeding roller to feed that film gripped between these rollers to that extent as determined by the relative rotation of the toothed member and the relative diameter of the film feeding roller.

2. An apparatus for advancing film as in claim 1 in which the movable frame is carried by and on four pivoted arm supports, said arm supports having one end pivotally secured to the fixed frame and the other end pivotally carrying the movable frame.

3. An apparatus for advancing film as in claim 1 in which the motive means includes a motor which moves a rotative shaft on which is mounted a crank arm which is pivotally connected to an end of and drives a pitman arm whose other end is connected in a pivoted manner and means to the movable frame to provide the to and from movement thereof.

4. An apparatus for advancing film as in claim 3 in which the connection between the crank arm and the pitman arm is made selectively adjustable so that the travel of the pitman arm and the attached movable frame is adjusted to suit the desired extent of travel of the movable frame.

5. An apparatus for advancing film as in claim 1 in which the motive means is a cylinder whose piston stroke is adjusted as to the extent and speed of travel, said cylinder being operatively attached at one end to the fixed frame and at the other end to an arm support to move the arm support in a determined path and extent.

6. An apparatus for advancing film as in claim 1 in which the film feed roller includes a plurality of like diameter, disclike members carried on a shaft, the disclike members having resilient outer diameter portions which mate with the pressure roller to maintain and drive the supplied film carried therebetween.

7. An apparatus for advancing film as in claim 6 in which the pressure roller includes land portions which are spaced so as to mate with the resilient portions of the film feed roller.

8. An apparatus for advancing film as in claim 1 in which the toothed member is a roller chain sprocket and the drive flexible drive means is a roller chain of like pitch.

9. An apparatus for advancing film as in claim 8 in which the roller chain is maintained with a wrap of about one-half of the circumference of the toothed drive sprocket, this wrap established and maintained by idler sprockets mounted on each side of the drive sprocket, these idler sprockets maintaining this desired wrap during both the forward and retun movement of the movable frame.

10. An apparatus for advancing film as in claim 9 in which the fixed end of the roller chain is operatively secured to an eccentrically mounted and moved member, a movement of this eccentrically mounted member being in response to a signal to change the extent of advance of film

11. An apparatus for advancing film as in claim 10 in which the other end of the roller chain is operatively attached to a tension spring having one end secured to the chain and the other end operatively attached to the fixed frame, the spring stretched sufficiently to provide the take-up means by which the chain is brought to and maintained in a taut condition.

12. An apparatus for advancing film as in claim 1 in which the toothed member is a timing belt pulley and the drive means is a toothed timing belt.

13. An apparatus for advancing film as in claim 12 in which the timing belt is maintained with a wrap of about one-half of the circumference of the toothed driven pulley, this wrap established and maintained by idler pulleys mounted on each side of the driven toothed pulley, the idler pulleys maintaining this wrap during both the forward and return movement of the movable frame.

14. An apparatus for advancing film as in claim 13 in which the fixed end of the timing belt is operatively secured to the fixed frame and the other end of the belt is operatively attached to a tension spring having one end operatively attached to the fixed frame and the other end operatively attached to the timing belt, this spring stretched sufficiently to provide the take-up means by which the timing belt is brought to and is maintained in a taut condition.

15. An apparatus for advancing film as in claim 14 in which the extent of timing belt between the attached fixed end and the driven pulley is operatively shortened by the actuation of a cylinder which displaces the timing belt a small amount sufficiently to move the film in accordance with a received signal.

16. An apparatus for advancing film as in claim 1 in which there is provided longitudinal and transverse sealing means by which open top bags are formed and there is provided transverse cutting means whereby these formed bags are separated from the strip of film.

17. An apparatus for advancing film as in claim 1 including die means for forming pockets and the like in a bottom film, means to fill said pockets with a selected product and means to feed a cover film material to the bottom film and attach this cover film material to the bottom film to provide packaged products.

18. An apparatus for advancing film as in claim 17 in which a serrating and severing means are selectively provided to sever the packaged products in desired multiples with the serrations when supplied providing a desired further means for separation on the point of sale, use and the like.

19. An apparatus for advancing film as in claim 17 in which the upper and lower rolls of supplied film material are carried on roll stands having brake means which brake is actuated to prevent excessive over feeding of the film from the roll during the film advancing cycle of the apparatus.

* * * * *